US008631760B2

(12) United States Patent
Isoda et al.

(10) Patent No.: US 8,631,760 B2
(45) Date of Patent: Jan. 21, 2014

(54) COATING TOOL

(75) Inventors: Takahiro Isoda, Gifu (JP); Atsushi Hayashi, Gifu (JP)

(73) Assignee: Mitsubishi Materials Corporation, Tokyo (JP)

( * ) Notice: Subject to any disclaimer, the term of this patent is extended or adjusted under 35 U.S.C. 154(b) by 339 days.

(21) Appl. No.: 12/860,348

(22) Filed: Aug. 20, 2010

(65) Prior Publication Data

US 2011/0041756 A1 Feb. 24, 2011

(30) Foreign Application Priority Data

Aug. 20, 2009 (JP) ..... 2009-191113
Mar. 30, 2010 (JP) ..... 2010-077437

(51) Int. Cl.

| | |
|---|---|
| ***B05C 5/00*** | (2006.01) |
| ***B05C 3/02*** | (2006.01) |
| ***B05B 1/00*** | (2006.01) |
| ***B05B 1/02*** | (2006.01) |

(52) U.S. Cl.

USPC ..... 118/300; 118/410

(58) Field of Classification Search

USPC ..... 118/300, 407, 410; 239/597, 601
See application file for complete search history.

(56) References Cited

FOREIGN PATENT DOCUMENTS

JP 09225372 A * 9/1997
JP 2004-321911 A 11/2004

OTHER PUBLICATIONS

English Translation doc JP-2004-312911-A.*
English Translation doc JP-09225372 A.*

* cited by examiner

*Primary Examiner* — Yewebdar Tadesse
(74) *Attorney, Agent, or Firm* — Edwards Wildman Palmer LLP

(57) ABSTRACT

Provided is a coating tool for forming a film having uniform thickness on a target by controlling precisely a flow-rate of a coating liquid, even if its viscosity is high. In the coating tool, a coating head 1 includes a pair of head members 10 and 20; a slot 3 is formed between a pair of interior surfaces 11 and 21, facing each other, of the head members 10 and 20; and a coating liquid flows through the slot 3 and is discharged from the tip of the coating head 1. An internal flow-rate control mechanism 60 is provided to control the flow-rate of the coating liquid in the slot 3 by adjusting a convexity and/or a concavity.

7 Claims, 8 Drawing Sheets

COATING TOOL

TECHNICAL FIELD

The present invention relates to a coating tool used for applying a coating liquid to the surface of a target to be coated, such as a sheet-shaped member and/or a panel-shaped member.

BACKGROUND ART

As such a coating tool, for example, a conventional coating tool is well known wherein: the coating tool has a coating head composed of a pair of head members; a pocket and a grooved slot are formed between two side surfaces of the above pair of head members facing each other; a coating liquid is supplied into the pocket; and the grooved slot extends from the pocket toward the tip side and is open into the tip of the coating head.

Such a coating tool is mounted on a coating apparatus so that the tip of the coating head faces an object to be coated, and the longitudinal direction (longitudinal direction of the slot) of the coating head is aligned with the width direction of the object. Further, the coating liquid is supplied into the pocket from a coating liquid tank by a supply pump, flows through the slot, and is discharged from the tip of the coating head. Thus, the coating liquid is applied to the surface of the object which moves relative to the tip of the coating head.

The coating tool equipped with the coating head is for applying such coating liquids as a color paste for a liquid crystal display and/or as a resist agent for a color filter. In order to form a stable coating film on a target such as a sheet-shaped member or a panel-shaped member, it is an important requirement that the coating liquid is applied evenly in the coating operation. Regarding this subject, Patent Document 1 mentions a coating tool with an adjuster for adjusting the width of the slot.

The coating tool mentioned in Patent Document 1 provides an adjuster unit in a concavity formed in the exterior surface of a head member. By operating the adjuster unit, the head member is deformed so as to increase the distance between a pair of wall surfaces in the concavity. At the same time, the one side head member is also elastically deformed so as to approach the other side head member; and then this elastic deformation narrows the width of a slot at the tip of a coating head. Thereby, it is possible to control the flow-rate of a coating liquid discharged from the tip of the coating head, and to obtain a uniform film thickness.

RELATED ART DOCUMENT

Patent Document

[Patent Document 1] Japanese Patent No. 3501159

SUMMARY OF THE INVENTION

Problems that the Invention is to Solve

Meanwhile, when applying a coating liquid having low viscosity (for example, several tens of cps), the coating tool described in the above Patent Document 1 is able to sufficiently control the flow-rate of the coating liquid by adjusting slightly the width of the slot at the tip of the coating head. However, for example, a coating liquid used for applying a rechargeable battery, namely, a secondary cell, has high viscosity (for example, several thousands of cps). To control the flow-rate of such coating liquid appropriately, the width of the slot should be adjusted to a wider width than that of a slot set to be used for the coating liquid having low viscosity as in the above case.

Here, it would seem that a tip of the coating head having poor rigidity must be easily deformable and allow the adjustable range of the width of the slot at the tip of the coating head to increase easily. However, the aforementioned coating liquid having such high viscosity makes the internal pressure of the slot increase, while the coating liquid is flowing therein. Thus, the tip of the coating head having poor rigidity cannot withstand the internal pressure; and then a problem arises in which a desired slot width cannot be maintained.

The invention has been made in view of such problems. The object thereof is to provide a coating tool capable of exactly performing control of the flow-rate to obtain a uniform film thickness, even if the viscosity of the coating liquid is high.

Means for Solving the Problems

In order to solve the above problems, the invention suggests the following means. The coating tool related to this invention is a coating tool which includes a coating head composed of a plurality of head members. A grooved slot is formed between two interior surfaces which face each other in the plurality of head members, extends in the longitudinal direction of the coating head, and is open into the tip of the coating head. Coating liquid flows through the slot, and is discharged from the tip of the coating head. A convexity which rises toward one side surface of the two interior surfaces, can be formed convexly on the other side surface of the two interior surfaces by elastically deforming a portion on the other side surface. A concavity which sinks away from the one side surface, can be formed concavely below the other side surface by elastically deforming the portion on the other side surface. An internal flow-rate control mechanism is provided to control the flow-rate of the coating liquid in the slot by adjusting the aforementioned convexity and/or concavity.

The coating tool with such features has a structure in which an inner width of the slot is adjustable locally so as to control the flow-rate of the coating liquid, not by adjusting the width of the slot at the tip of the coating head, but by forming the convexity and/or the concavity at a portion on the interior surface in the head member. Therefore, the structure allows the slot to maintain a wide range sufficient for adjusting its inner width without losing good rigidity at the tip of the coating head.

Additionally, the coating tool related to the invention may include a plurality of the internal flow-rate control mechanisms arranged in the longitudinal direction. In this case, the flow-rate can be controlled at will in the longitudinal direction of the coating head. Thus, a high precision flow-rate control can be performed.

Moreover, in the coating tool related to the invention, the internal flow-rate control mechanism includes a concavity formed in the exterior surface of the other side head member at the rear of the other side interior surface; and a pushing/pulling mechanism which pushes and/or pulls the bottom of the concavity.

According to the coating tool with such a feature, a pushing/pulling member pushes and/or pulls the bottom of the concavity. Thereby, the interior surface at the rear of the bottom of the concavity in the other side head member can rise convexly toward the one side interior surface, and/or can sink concavely into the other side member away from the one side interior surface.

Additionally, in the coating tool related to the invention, the pushing/pulling mechanism includes a pushing/pulling member and a rotational moving member. The pushing/pulling member extends along a direction to which the bottom is pushed and/or pulled, and one end of the pushing/pulling member is fixed to the bottom. The rotational moving member has a cylindrical shape. An inner circumferential surface of the rotational moving member is rotatably attached to the pushing/pulling member by a first thread portion. An outer circumferential surface of the rotational moving member is rotatably attached to the other side head member by a second thread portion. Also a pitch of the first thread portion is set to be different from that of the second thread portion.

In the coating tool with such a feature, when turning the rotational moving member, the rotational moving member moves relative to the pushing/pulling member, according to the pitch of the first thread portion, along the axis. Concurrently with this move, the rotational moving member also moves relative to the other side head member, according to the pitch of the second thread portion, along the axis. Here, for example, the pitch of the first thread portion is set to be smaller than that of the second thread portion. In this case, the rotational moving member moves relative to the other side head member, according to the differential between the pitch of the first thread portion and that of the second thread portion, along the axis. Such a movement of the pushing/pulling member enables the bottom of the concavity where the pushing/pulling member is fixed to be pushed and/or to be pulled in the direction of the axis. Thus, the moving distance of the pushing/pulling member can be shorter than that of the rotational moving member which is caused by its rotation. Therefore, a fine adjustment in which the bolt member slightly pushes and/or pulls the bottom of the concavity can be performed.

Moreover, in the coating tool related to the invention, the pushing/pulling mechanism may be movable in the longitudinal direction. In this case, the pushing/pulling mechanism can be arranged at a position in the longitudinal direction where the width of the slot, which is dependent on using conditions, changes easily over time. Thus, high precision flow-rate control can be performed.

Additionally, in this coating tool, preferably, the pushing/pulling mechanism includes a first sliding member provided at the bottom so as to be slidable in the longitudinal direction; a second sliding member provided at the other side head member so as to be slidable in the longitudinal direction; a pushing/pulling member; and a rotational moving member. The pushing/pulling member extends along a direction to which the bottom is pushed and/or pulled, and one end of the pushing/pulling member is fixed to the first sliding member. The rotational moving member has a cylindrical shape. An inner circumferential surface of the rotational moving member is rotatably attached to the pushing/pulling member by a first thread portion. An outer circumferential surface of the rotational moving member is rotatably attached to the second sliding member by a second thread portion. Also, a pitch of the first thread portion is set to be different from that of the second thread portion.

In this coating tool, by sliding, i.e. by moving the first sliding member and/or the second sliding member in the longitudinal direction, the pushing/pulling mechanism can be located at an arbitrary position in the longitudinal direction. Also, in this situation, when turning the rotational moving member, the pushing/pulling member moves along the axis, the same as the above. Further this movement can push and/or pull the bottom by the first sliding member. Thereby, a fine adjustment for pushing and/or pulling the bottom at an arbitrary position in the longitudinal direction can be performed.

Advantage of the Invention

According to the coating tool related to the invention, a wide range sufficient for adjusting the inner width of the slot can be maintained without losing good rigidity at the tip of the coating head. Therefore, the coating tool is capable of exactly performing the flow-rate control to obtain a uniform film thickness, even if the viscosity of the coating liquid is high.

BEST MODE FOR CARRYING OUT THE INVENTION

Figure 1:
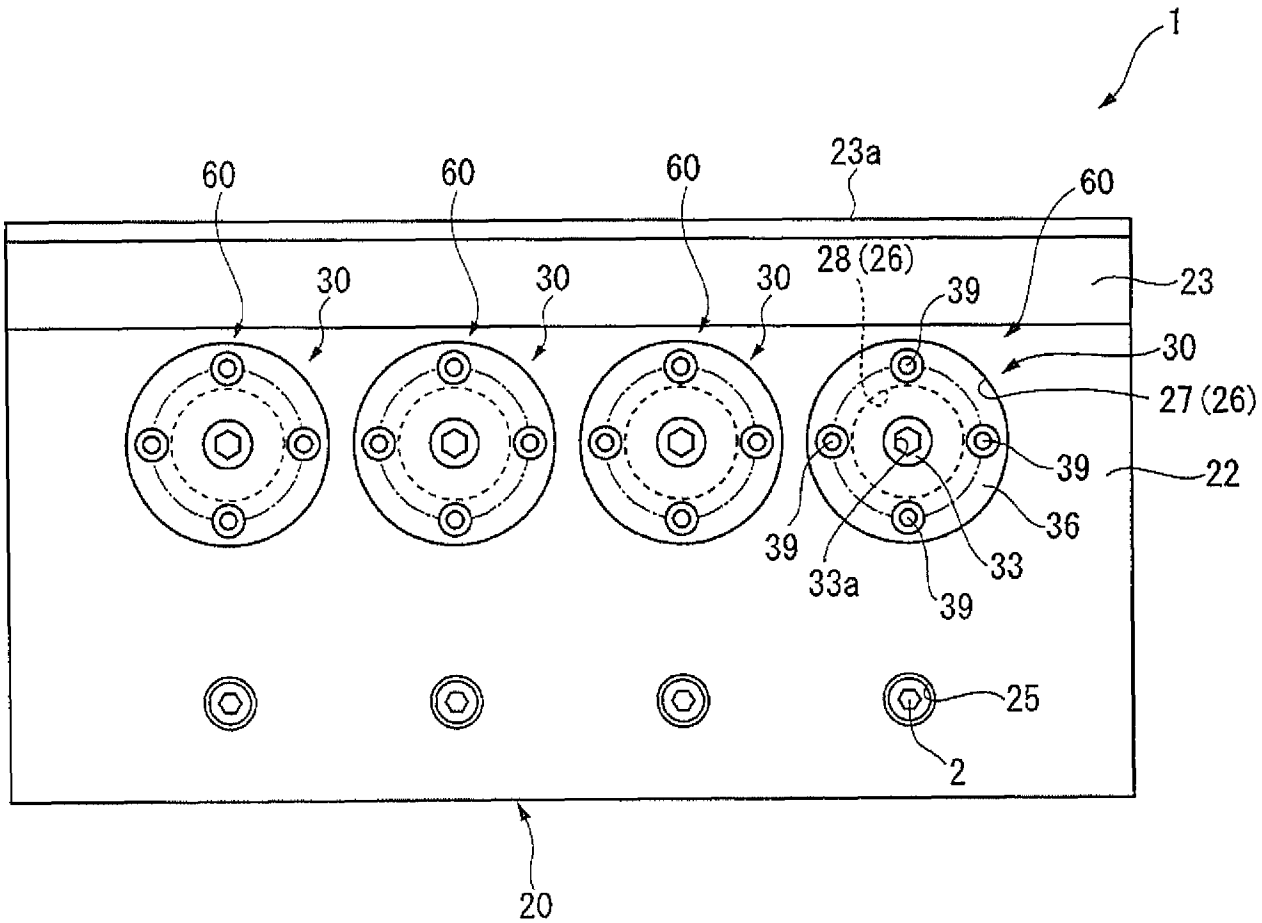
FIG. 1 is a side view of a coating head used in a coating tool of a first embodiment.
Figure 2:
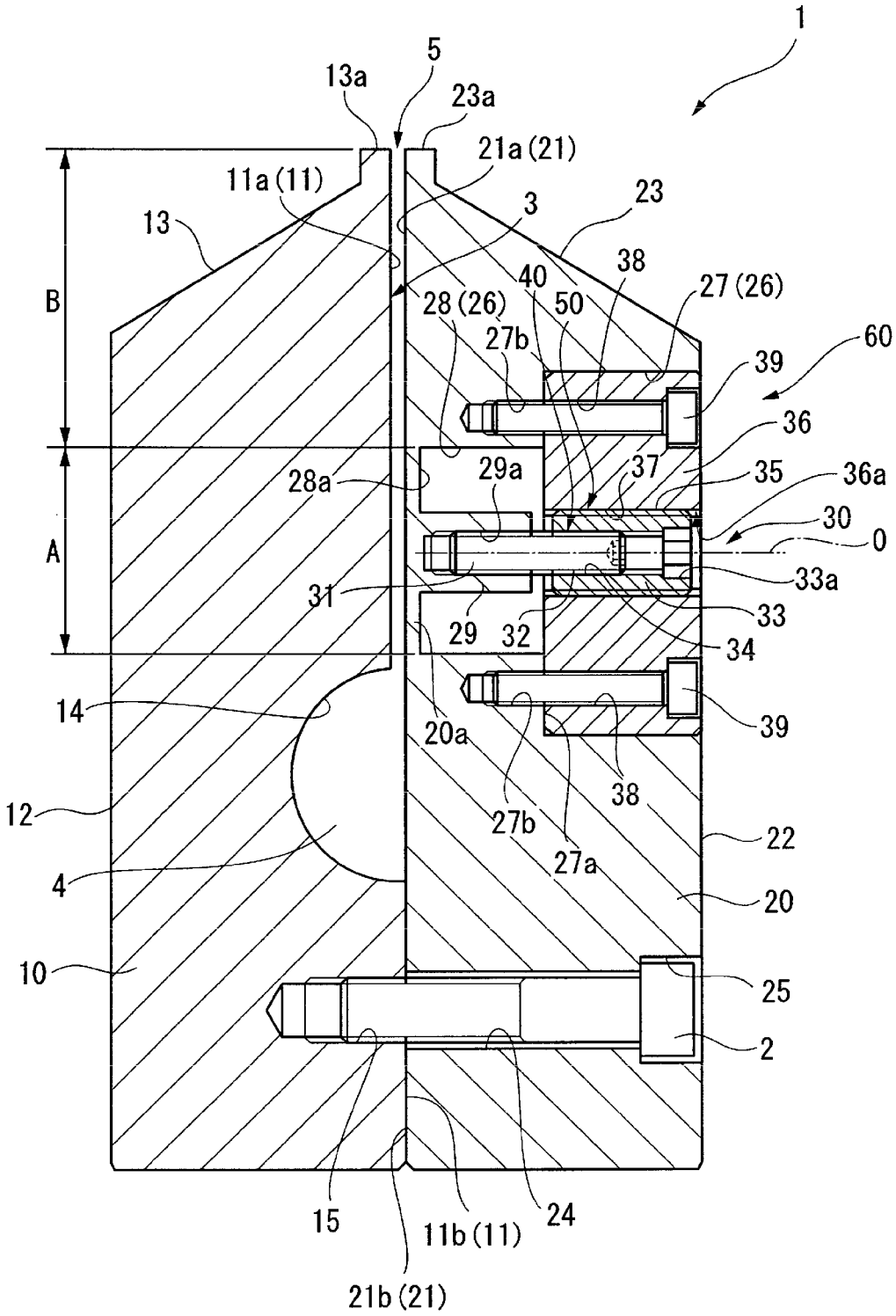
FIG. 2 is a sectional view perpendicular to the longitudinal direction of the coating head shown in FIG. 1.

Hereinafter, a first embodiment of the invention will be described in detail with reference to the drawings. FIGS. 1 and 2 show a coating head 1 prepared for mounting on a coating tool related to the first embodiment. The coating head 1 is composed of a pair of head members 10 and 20 which extends in the longitudinal direction (a horizontal direction in FIG. 1). In addition, at least the head member 20 of the head members 10 and 20 is made of a material which is elastically deformable, such as steel, or the like.

In one side head member 10: a tip side (upper side in FIGS. 1 and 2) portion of an interior surface 11 which faces the other side head member 20, is as a slot surface 11*a*; and a rear end side (lower side in FIGS. 1 and 2) portion is as an abutting surface 11*b*. A pocket groove 14 which has a semicircular shape in a cross-section and extends along the longitudinal direction, is formed between the slot surface 11*a* and the abutting surface 11*b*. The slot surface 11*a* and the abutting surface 11*b* are parallel to each other. Also, a plane of the slot surface 11*a* recedes outwardly slightly (in a direction away from the other side head member 20) from that of the abutting surface 11*b*.

Additionally, in the one side head member 10, a plurality of (four in this embodiment) bolt-holes 15 are provided in the longitudinal direction at predetermined intervals. The bolt-holes 15 are open into the abutting surface 11*b*, and also extend in a direction perpendicular to the abutting surface 11*b*.

In the other side head member 20; an interior surface 21 which faces the one side head member 10 is formed uniformly and evenly, a slot surface 21*a* faces the slot surface 11*a* of the one side head member 10, and an abutting surface 21*b* abuts on the abutting surface 11*b* of the one side head member 10.

Additionally, a plurality of (four in this embodiment) bolt insertion holes 24 are provided in the longitudinal direction at predetermined intervals. The bolt insertion holes 24 are open into the abutting surface 21*b*, extend in a direction perpendicular to the abutting surface 21*b*, and go through across the other side head member 20. In an exterior surface 22 of the other side head member 20, a countersunk hole 25 is provided on the inside of the opening of the bolt insertion holes 24. The internal diameter of the countersunk hole 25 is a size larger than that of the bolt insertion hole 24.

The pair of head members 10 and 20 is arranged so as to have a construction in which the pair of head members 10 and 20 face each other; the abutting surface 11*b* of the one side head member 10 and the abutting surface 21*b* of the other side head member 20 closely contact with each other; and the axis of the bolt-holes 15 and the axis of the bolt insertion holes 24 are coaxial. Additionally, to combine firmly the pair of head members 10 and 20 into a unit; coupling bolts 2 are inserted into the bolt insertion holes 24, and are screwed into the bolt holes 15. Therefore, a small gap is formed between the slot surface 11*a* of the one side head member 10 and the slot surface 21*a* of the other side head member 20; and then a slot 3 which is open into the tip side of the coating head 1, is formed. Moreover, a pocket 4 is formed with the pocket groove 14 and the interior surface 21 of the other side head member 20.

The slot 3 and the pocket 4 are formed so as to extend in the longitudinal direction of the head members 10 and 20. Also the slot 3 and the pocket 4 are connected by a rear side portion of the slot 3. Further, the slot surface 11*a* of the one side head member 10 and the slot surface 21*a* of the other side head member 20 are parallel to each other. Thereby, the slot 3 extends from the pocket 4 to the tip side with a constant width.

Additionally, FIG. 2 shows that tip surfaces 13 and 23 of the head members 10 and 20 are inclined surfaces in a cross-section perpendicular to the longitudinal direction of the head members 10 and 20. From the exterior surfaces 12 and 22 to the interior surfaces 11 and 21, the inclined surfaces, namely, the tip surfaces 13 and 23 are tapered so as to protrude toward the tip side. Also, the coating head 1 has a substantially pentagonal shape in the cross-section perpendicular to the longitudinal direction.

In addition, protrusions 13*a* and 23*a* which protrude toward the tip side, and extend in the longitudinal direction, are formed at the junctions of the tip surface 13 and the interior surfaces 11 in the head member 10, and of the tip surface 23 and the interior surface 21 in the head member 20. An opening of the slot 3 between the pair of the protrusions 13*a* and 23*a* is used as a discharge port 5.

A plurality of (four in this embodiment) concavities 26, which are sunk below the exterior surface 22 of the other side head member 20 in a direction perpendicular to the exterior surface 22, are provided in the longitudinal direction at predetermined intervals.

Figure 3:
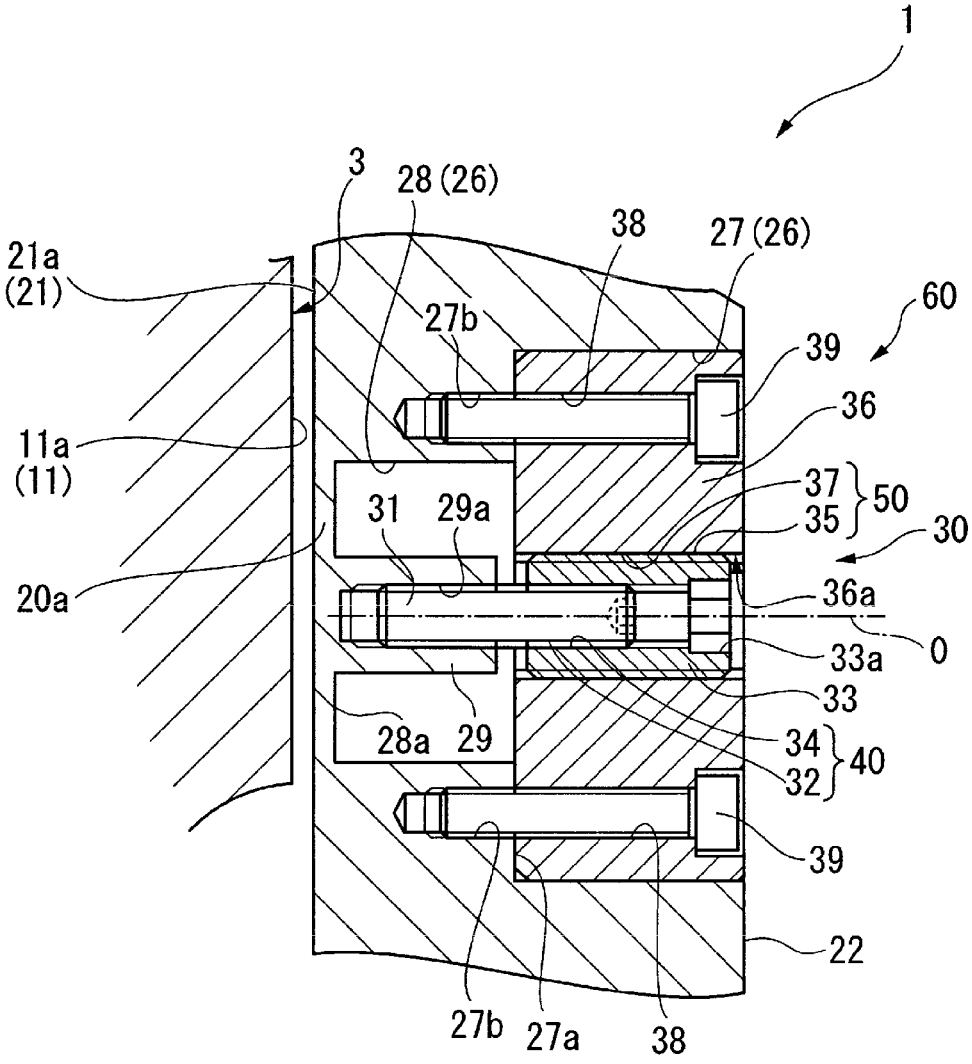
FIG. 3 is an enlarged view of the vicinity of an internal flow-rate control mechanism in FIG. 2.

In detail, FIG. 3 shows that the concavities 26 have a shape in two cylindrical tiers with an axis O as its center axis perpendicular to the interiors surface 21. The concavities 26 are composed of a first concavity 27 and a second concavity 28. The first concavity 27 is sunk below the exterior surface 22 to an approximately middle position of the head member 20 in its width direction (horizontal direction in FIG. 2). The second concavity 28 is also sunk below a bottom 27*a* of the first concavity 27. The internal diameter of the second concavity 28 is a size smaller than that of the first concavity 27.

A plurality of (four for each first concavity 27 in this embodiment) bolt-holes 27*b* which extend in a direction parallel to the axis O, are provided at regular intervals around the second concavity 28 in the bottom 27*a* of the first concavity 27.

The bottom 28*a* of the second concavity 28 is located at the rear side of a portion which is on the slot surface 21*a* and is close to the pocket 4. Since the second concavity 28 is provided thereat, the portion which is on the slot surface 21*a* of the other side head member 20 and is close to the pocket 4, has a thin width. In other words, the bottom 28*a* and the slot surface 21*a* are located back to back with each other through a thin portion 20*a* in the head member 20.

Also, a bolt fixing portion 29 is formed at the center of the bottom 28*a* of the second concavity 28. The bolt fixing portion 29 has a cylindrical shape with the axis O as its center axis, and extends along the axis O toward the exterior surface 22. Further, a bolt fixing hole 29*a* is open at the tip of the bolt fixing portion 29. The bolt fixing portion 29 is housed in the second concavity 28. That is, the top of the bolt fixing portion 29 is located toward the interior surface 21 below the bottom 27*a* of the first concavity 27.

Further, in this embodiment, as shown in FIG. 2, the section of the slot 3 located at the rear side of the bottom 28*a* of the second concavity 28, is used as a flow-rate control area A; and the section of the slot 3 which extends toward the tip side from the flow-rate control area A, is used as a flow-rate stabilizing area B where the width of the slot 3 is constant. The flow-rate control area A is positioned at the portion close to the pocket 4, and the flow-rate stabilizing area B has a sufficient length in an extension direction of the slot 3 to stabilize the flow-rate.

In this embodiment, a pushing/pulling mechanism 30 which pushes and/or pulls the bottom 28*a* of the second concavity 28 along the axis O, is provided in each concavity 26. Further, the pushing/pulling mechanism 30 and the concavity 26 compose an internal flow-rate control mechanism 60. The pushing/pulling mechanism 30 includes a pushing/pulling member 31 and a rotational moving member 33, and also includes a lid member 36 to be fixed to the other side head member 20 by coupling bolts 39.

The pushing/pulling member 31 is a bolt-shaped member. A first external thread 32 is formed on the outer circumferential surface of the pushing/pulling member 31 throughout. One end surface of the pushing/pulling member 31 is screwed into the bolt fixing hole 29*a* of the bolt fixing portion 29. Thereby, the pushing/pulling member 31 is fixed to the bolt fixing portion 29 so as to extend toward the exterior surface 22 along the axis O. Further, in such a state, the pushing/pulling member 31 is fixed, and then the other end of the pushing/pulling member 31 extends to the inside of the first concavity 27 within each concavity 26.

The rotational moving member 33 is a substantially cylindrical member. A first internal thread 34 is formed on the inner circumferential surface of the rotational moving member 33, and is screwed onto the first external thread 32 of the pushing/pulling member 31. By inserting the tip side of the pushing/pulling member 31 into the rotational moving member 33 from its one end side, and by screwing the first external thread 32 into the first internal thread 34; the rotational moving member 33 is rotatably attached to the pushing/pulling member 31. Thereby, when tuning the rotational moving member 33 relative to the pushing/pulling member 31, the rotational moving member 33 and the pushing/pulling member 31 move relative to each other along the axis O.

Also, a hexagonal-shaped wrench fitting hole 33*a* is formed in an opening at the other end side of the inner circumferential surface of the rotational moving member 33.

Moreover, a second external thread 35 is formed on the outer circumferential surface of the rotational moving member 33, and extends coaxially with the first internal thread 34 formed on the inner circumferential surface.

The lid member 36 is a disk-shaped member, and the depth thereof is substantially equal to that of the first concavity 27 in each concavity 26. A through hole 36*a* which goes through across the width, is bored at the center of the lid member 36. A second internal thread 37 is formed on the inner wall of the through hole 36*a*. The second external thread 35 of the rotational moving member 33 is screwed into the second internal thread 37. Further, a plurality of (four for each first concavity 27 in this embodiment) bolt insertion holes 38 which go through across the width, are provided at regular intervals around the through hole 36*a* of the lid member 36.

The lid member 36 makes the second internal thread 37 formed in the through hole 36*a* be screwed onto the second external thread 35 of the rotational moving member 33. Further, in a state where the axis of the bolt holes 27*b* provided in the bottom 27*a* of the first concavity 27 and the axis of the bolt insertion holes 38 of the lid member 36 are coaxial with each other; the lid member 36 is housed in the first concavity 27 in each concavity 26. By inserting the coupling bolts 39 through the bolt insertion holes 38, and also by attaching threadedly the coupling bolts 39 into the bolt holes 27*b*, the lid member 36 is firmly fixed into the other side head member 20. Thereby, when turning the rotational moving member 33, the rotational moving member 33 turns relative to the lid member 36. In other words, the rotational moving member 33 and the other side head member 20 rotate relative to each other. In this state, the rotational moving member 33 moves relative to the other side head member 20, according to the pitches of the second external thread 35 and the second internal thread 37, along the axis O.

In this embodiment, a first thread portion 40 is composed of the first external thread 32 and the first internal thread 34; and a second thread portion 50 is composed of the second external thread 35 and the second internal thread 37. Also, the pitch of the first thread portion 40 is set to be smaller than that of the second thread portion 50.

To push and/or to pull the bottom 28*a* of the second concavity 28 by the pushing/pulling mechanism 30 having such an aforementioned structure, a hexagonal wrench is fitted into the wrench fitting hole 33*a* of the rotational moving member 33. By turning the rotational moving member 33 with the wrench, the rotational moving member 33 moves relative to the pushing/pulling member 31, according to the pitch of the first thread portion 40, along the axis O. Also, the rotational moving member 33 moves relative to the lid member 36, namely, the other side head member 20, according to the pitch of the second thread portion 50, along the axis O.

Here, in this embodiment, the pitch of the first thread portion 40 is set to be smaller than that of the second thread portion 50. Therefore, the rotational moving member 31 moves relative to the other side head member 20, according to the differential between the pitch of the first thread portion 40 and that of the second thread portion 50, along the axis O. Since the pushing/pulling member 31 is fixed to the bottom 28*a* of the second concavity 28, the bottom 28*a* can be pushed and/or pulled in the direction of the axis O by this movement of the pushing/pulling member 31.

Figure 4:
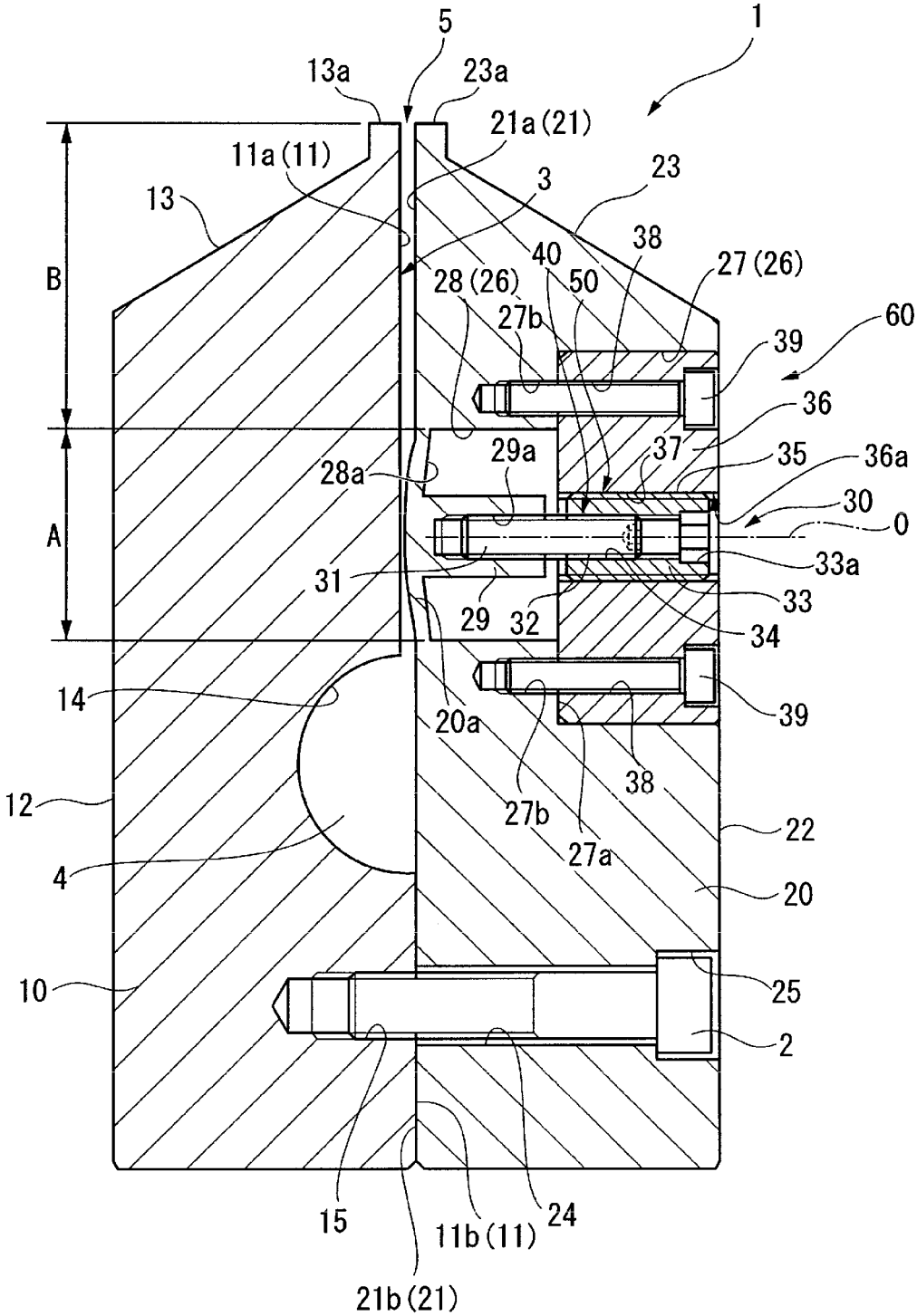
FIG. 4 is a sectional view perpendicular to the longitudinal direction when performing the flow-rate control of a coating liquid in the coating head shown in FIG. 1.

By pushing and/or pulling the bottom 28*a* of the second concavity 28 in such an aforementioned manner, as shown in FIG. 4, the thin portion 20*a* is elastically deformed; and then the rear side of a portion of the bottom 28*a* on the slot surface 21*a* of the other side head member 20, is elastically deformed, too. In other words, the slot surface 21*a* of the other side head member 20 rises convexly toward the slot surface 11*a* of the one side head member 10, and/or sinks concavely below the slot surface 21*a* away from the slot surface 11*a* of the one side head member 10. Thereby, the width of the slot 3 can be adjusted in the flow-rate control area A.

A coating tool equipped with the coating head 1 having the above structure is mounted on a coating apparatus so as to be used for coating work. In the coating work, a coating liquid is supplied from the coating apparatus through a supply port (not shown in the Figs.) into the coating head 1, and then is filled into the pocket 4. Thereby, the coating liquid spreads in the longitudinal direction of the coating head 1, flows through the slot 3 connected with the pocket 4, and is discharged from the tip of the coating head 1, namely, the discharge port 5. Therefore, the coating liquid is applied to the surface of the object which moves relative to the coating head 1.

The coating tool of this embodiment has a structure in which; an inner width of the slot 3 is adjustable locally so as to control the flow-rate of the coating liquid, not by adjusting the width of the discharge port 5 at the tip of the head members 10 and 20, but by forming the convexity and/or the concavity at a portion of the interior surface 21 in the other side head member 20. Therefore, the structure allows the slot 3 to maintain a wide range sufficient for adjusting its inner width without losing good rigidity at the protrusion 13*a* and 23*a*.

A coating liquid used for coating a rechargeable battery has high viscosity (for example, several thousands of cps). To control the flow-rate of such a coating liquid appropriately, the width of the slot 3 should be adjusted to a wider width than that of a slot 3 set to be used for the coating liquid having low viscosity (for example, several tens of cps). Furthermore, the coating liquid having such high viscosity makes the internal pressure of the slot 3 increase, while the coating liquid is flowing therein. Thus, the head members 10 and 20 are required to have high rigidity. That is, a structure in which the head members 10 and 20 have poor rigidity so as to become easily deformable so as to increase the adjustable range of the width of the slot 3, does not allow the flow-rate of the coating liquid having high viscosity to be controlled appropriately.

On the other hand, in this embodiment, the structure for adjusting the width of the slot 3 is to form the convexity and/or the concavity at a portion of the interior surface 21 in the slot 3. Thus, the structure allows the slot 3 to maintain a wide range sufficient for adjusting its inner width without losing the good rigidity. Therefore, the coating tool is capable of appropriately performing the flow-rate control to obtain a uniform film thickness, even if the viscosity of the coating liquid is high.

Here, a structure in which the discharging-rate of a coating liquid is controlled by adjusting the width of the slot 3 at the tip, i.e., by adjusting the width of the discharge port 5 in the slot 3, is exemplified. In this case, the coating liquid which has been flowing through the slot 3 and is just about to discharge, is forced to change its flowing direction. Therefore, when the coating liquid is applied on the surface of a target to be coated, the flow of the coating liquid is disturbed. In this state, the coating liquid flowing with great turbulence may hinder the formation of a uniform film on the target.

In this regard, in this embodiment, the coating liquid flows from the pocket 4 into the slot 3, the flow-rate control area A inside the slot 3 controls the flow-rate of the coating liquid; and subsequently flows through the flow-rate stabilizing area B, whereby the coating liquid is discharged from the discharge port 5 and is applied on the target. Thus, even if the flow of the coating liquid is disturbed and becomes turbulent in the flow-rate control area A, the flow will change to a laminar flow before arriving at the discharge port 5 as a result of flowing through the flow-rate stabilizing area B composed of the slot surfaces 11*a* and 21*a* parallel to each other. Therefore, the coating liquid can be discharged and applied on the target without the flow being turbulent, and then the film having a highly uniform thickness can be formed on the target.

Additionally, in this embodiment, a plurality of the internal flow-rate control mechanisms 60 are arranged in the longitudinal direction of the coating head 1. Thus, the flow-rate can be controlled at will in the longitudinal direction of the coating head 1. Therefore, high precision flow-rate control can be performed.

Moreover, in this embodiment, in the pushing/pulling mechanism 30, the pitch of the first thread portion 40 is set to be smaller than that of the second thread portion 50. Further, when turning the rotational moving member 33, the pushing/pulling member 31 moves relative to the other side head member 20, according to the differential between the pitch of the first thread portion 40 and that of the second thread portion 50, along the axis O. Thus, the moving distance of the pushing/pulling member 31 can be shorter than that caused by the rotation of the rotational moving member 33. Therefore, the fine adjustment in which the pushing/pulling member 31 slightly pushes and/or pulls the bottom 28*a* can be performed; and then a high precision flow-rate control can also be performed.

Figure 5:
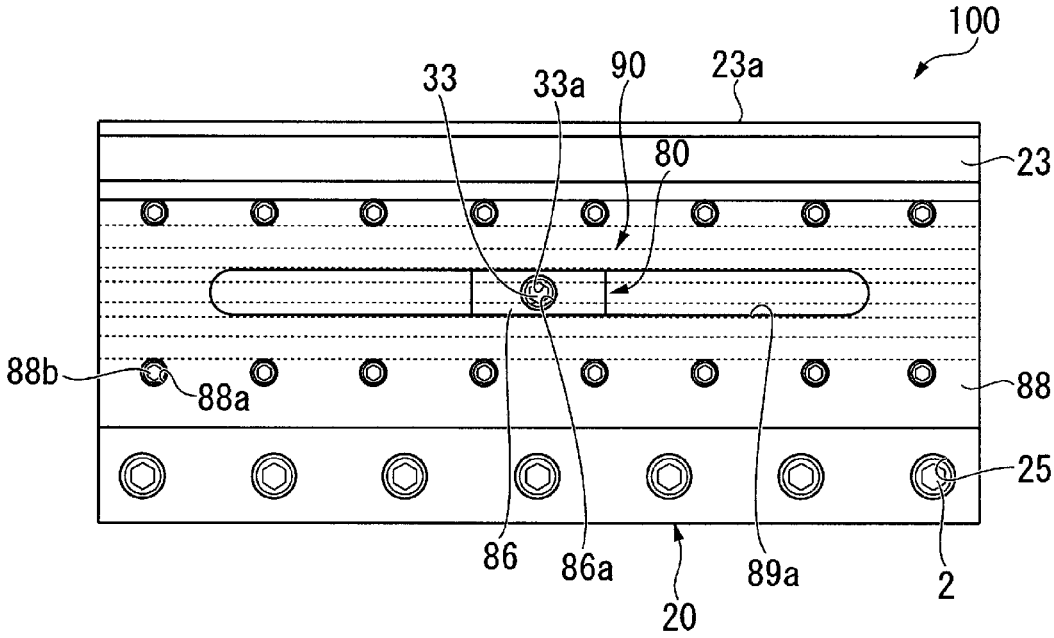
FIG. 5 is a side view of a coating head used in a coating tool of a second embodiment.
Figure 6:
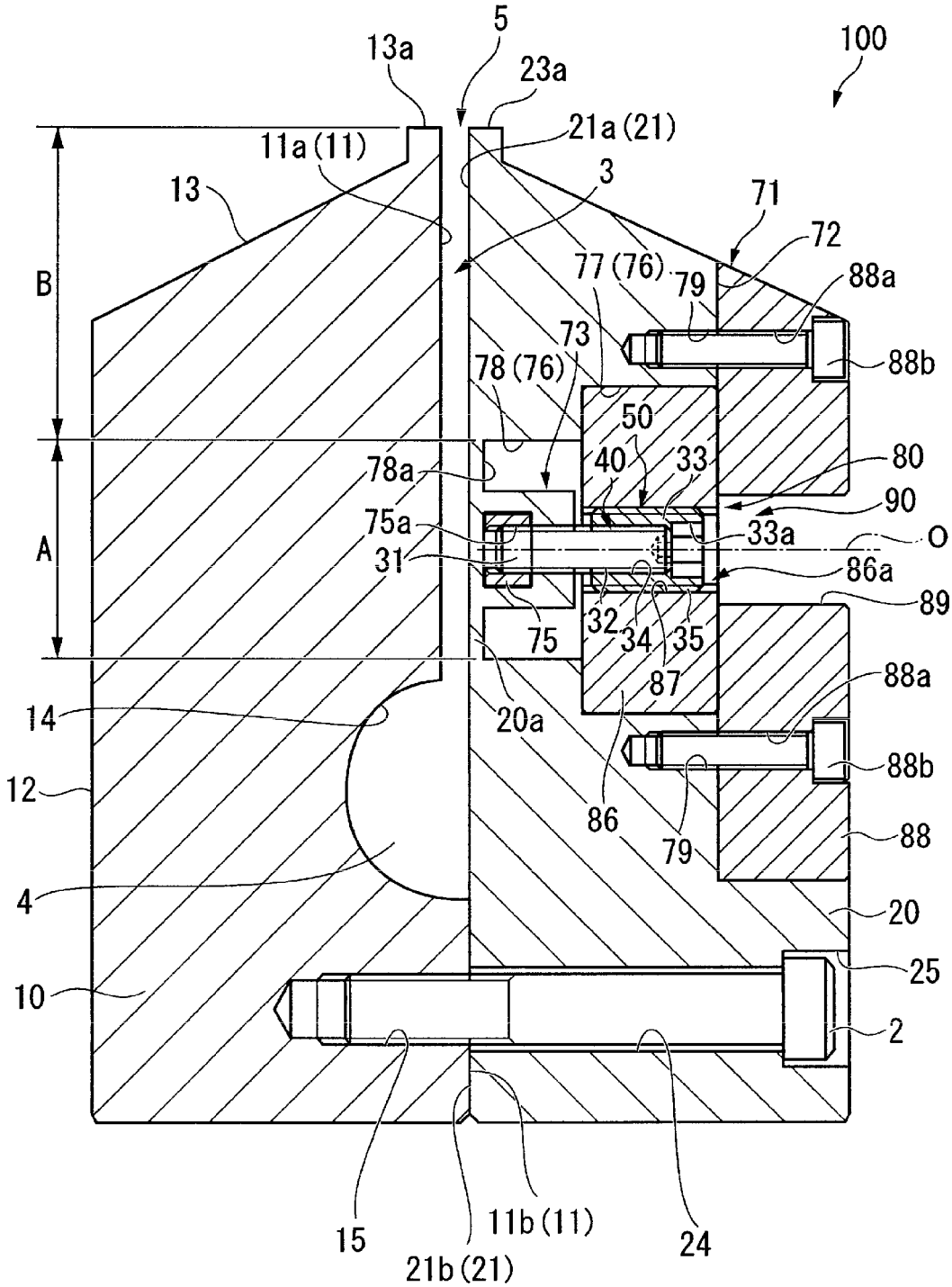
FIG. 6 is a sectional view perpendicular to the longitudinal direction of the coating head shown in FIG. 5.

Next, a second embodiment of the invention will be described in detail with reference to the drawings. FIGS. 5 and 6 show a coating head 100 mounted on a coating tool related to the second embodiment. In addition, in the second embodiment, the same components as those of the first embodiment will be denoted by the same reference numerals, and the detailed description thereof will be omitted.

As shown in FIGS. 5 and 6, the coating head 100 of the second embodiment is similar to that of the first embodiment, and is composed of a pair of head members 10 and 20 which extends in the longitudinal direction (the horizontal direction in FIG. 5). To combine firmly the pair of head members 10 and 20 into a unit, coupling bolts 2 are inserted into a plurality of (seven in this embodiment) bolt insertion holes 24 provided in the other side head member 20, and are screwed into a plurality of (seven in this embodiment) bolt holes 15 provided in the one side head member 10.

As shown in FIG. 6, a cutout portion 71, substantially L-shaped in a cross-section perpendicular to its longitudinal direction, is formed in the other side head member 20 of this second embodiment. The surface of the cutout portion 71 is an exterior surface 72 which faces in the opposite direction to the one side head member 10.

A concave groove (concavity) 76 is formed in the exterior surface 72 of the other side head member 20. The concave groove 76 is sunk below the exterior surface 72 in a direction perpendicular thereto toward the one side head member 10, and extends in the longitudinal direction of the other side head member 20 throughout.

Figure 7:
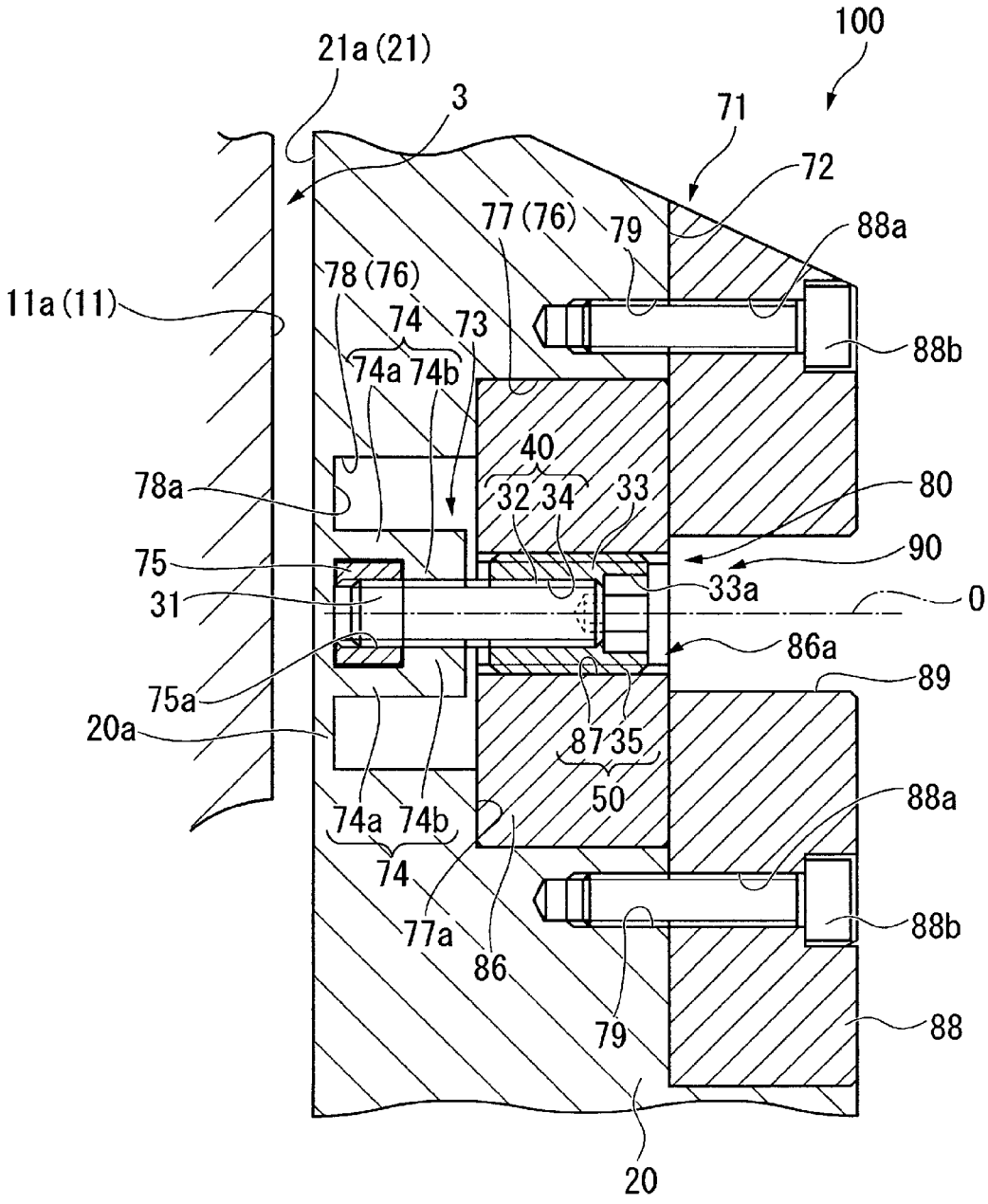
FIG. 7 is an enlarged view of the vicinity of an internal flow-rate control mechanism in FIG. 6.

In detail, as shown in FIG. 7, in a cross-section perpendicular to the longitudinal direction, the concave groove 76 has a shape in two groove tiers. The center position of the concave groove 76 in its groove width direction (vertical direction in FIG. 7) is as an axis O perpendicular to an interior surface 21. Further the concave groove 76 is composed of a first concave groove 77 and a second concave groove 78. The first concave groove 77 is sunk below the exterior surface 72 in the width direction (horizontal direction in FIG. 6) of the other side head member 20. The second concave groove 78 is also sunk below a bottom 77*a* of the first concave groove 77 at the center position thereof. The groove width of the second concave groove 78 is a groove tier size narrower than that of the first concave groove 77.

A bottom 78*a* of the second concavity 78 is located at the rear side of a portion which is on the interior surface 21 and is close to the pocket 4. Since the second concavity 78 is provided thereat, the portion which is on the slot surface 21*a* of the other side head member 20 and is close to the pocket 4, is formed with a thin width. In other words, the bottom 78*a* and the interior surface 21 are located back to back with each other through a thin portion 20*a* in the other side head member 20.

A portal guide portion 73, which is composed of a pair of L-shaped guides 74 and 74 which extend in the longitudinal direction of the other side head member 20 throughout, is provided on the bottom 78*a* of the second concavity 78. In a cross-section perpendicular to the longitudinal direction, the L-shaped guides 74 and 74 are arranged so as to form a configuration in which the axis O is located between the L-shaped guides 74 and 74 in the groove width direction of the second concave groove 78, and the L-shaped guides 74 and 74 face each other through the axis O. In other words, the L-shaped guides 74 and 74 are line symmetrical with respect to the axis O in the cross-section.

In the above cross-section, the L-shaped guides 74 and 74 have a substantial L shape composed of side walls 74*a* and 74*a*, and overhangs 74*b* and 74*b*. In the cross-section, the side walls 74*a* and 74*a* extend in a direction toward the exterior surface 72 (the right side in FIG. 7) from the bottom 78*a* to ends which are the nearest portions to the exterior surface 72 within the side walls 74*a* and 74*a*, and the overhangs 74*b* and 74*b* go from the above ends so as to approach each other. The L-shaped guides 74 and 74 which have such a cross-sectional shape, extend in the longitudinal direction of the other side head member 20 throughout; and then the portal guide portion 73 is formed therein.

Additionally, in this embodiment, a pushing/pulling mechanism 80 which pushes and/or pulls the bottom 78*a* of the second concave groove 78 along the axis O, is provided in the concave groove 76. In this embodiment, an internal flow-rate control mechanism 90 is composed of the pushing/pulling mechanism 80 and the concave groove 76.

The pushing/pulling mechanism 80 includes a first sliding member 75, a pushing/pulling member 31, a rotational moving member 33, a second sliding member 86, and a lid plate 88. In the portal guide portion 73, the first sliding member 75 is provided so as to be housed between the side walls 74*a* and 74*a* of the pair of L-shaped guides 74 and 74. The first sliding member 75 forms a substantially rectangular parallelepiped shape, and is arranged where it can abut on: the bottom 78*a*; the inner surfaces of the side walls 74*a* and 74*a* which face each other; and the inner surfaces of the overhangs 74*b* and 74*b* which face the bottom 78*a*. Further, the first sliding member 75 is slidable along the extension direction of the L-shaped guides 74 and 74. In other words, the first sliding member 75 provided at the bottom 78*a* so as to be slidable in the longitudinal direction.

One end side of the pushing/pulling member 31 is inserted between the overhangs 74*b* and 74*b* in the pair of L-shaped guides 74 and 74 of the portal guide portion 73, and is screwed into a bolt fixing hole 75*a* formed in the first sliding member 75. Thereby, the pushing/pulling member 31 extends along the axis O, and is fixed to the first sliding member 75 as a unit. A first internal thread 34 of the rotational moving member 33 is screwed onto the first external thread 32 formed on the tip side surface of the outer circumferential surface of the pushing/pulling member 31. Therefore, the rotational moving member 33 is rotatable relative to the pushing/pulling member 31 on the axis O.

The second sliding member 86 is housed in the first concavity 77 in the concave groove 76 so as to be slidable in the longitudinal direction. Further, the second sliding member 86 includes a through hole 86*a* which goes through in the direction of the axis O. The rotational moving member 33 is housed in the through hole 86*a*. A second internal thread 87 is formed on the inner wall of the through hole 86*a*. The second external thread 35 of the rotational moving member 33 inserted into the through hole 86*a*, is screwed into the second internal thread 87. Therefore, the rotational moving member 33 is rotatable relative to the second sliding member 86 on the axis O.

Since this embodiment is similar to the first embodiment, the first thread portion 40 is composed of the first external thread 32 and the first internal thread 34. On the other hand, the second thread portion 50 is composed of the second external thread 35 and the second internal thread 87. The pitch of the first thread portion 40 is set to be smaller than that of the second thread portion 50.

The lid plate 88 is a plate-shaped member which is arranged all over the exterior surface 72 of the other side head member 20, as shown in FIGS. 5 to 7. The lid plate 88 includes a wrench insertion slit 89 which goes through in the direction of the axis O, and extends along the longitudinal direction, in a cross-sectional view perpendicular to the longitudinal direction. The dimension of this wrench insertion slit 89 in the groove width direction is smaller than that of the second sliding member 86 in the same direction. Thereby, even in a situation that the through hole 86*a* of the second sliding member 86 is connected with the wrench insertion slit 89, the lid plate 88 abuts on the second sliding member 86 from the exterior surface 72 side in order to hold the second sliding member 86 within the first concave groove 77.

The lid plate 88 includes a plurality of bolt insertion holes 88*a* on both sides of the wrench insertion slit 89 in the groove width direction. The insertion holes 88*a* are arranged at regular intervals in the longitudinal direction. Coupling bolts 88*b* are inserted into the bolt insertion holes 88*a*; and also the coupling bolts 88*b* are screwed into the bolt-holes 79 formed in the exterior surface 72 of the other side head member 20. Thereby, the lid plate 88 is fixed to the other side head member 20 as a unit.

To push and/or to pull the bottom 78*a* of the second concavity 76 by the pushing/pulling mechanism 80 having such structure; a hexagonal wrench is inserted through the wrench insertion slit 89 of the lid plate 88, and the hexagonal wrench is fitted into the wrench fitting hole 33*a* of the rotational moving member 33. Further, by turning the rotational moving member 33 with the wrench, the rotational moving member 33 moves relative to the pushing/pulling member 31, according to the pitch of the first thread portion 40, along the axis O. Also, the rotational moving member 33 moves relative to the lid plate 88, namely, the other side head member 20, according to the pitch of the second thread portion 50, along the axis O.

When moving the pushing/pulling member 31 relative to the bottom 78*a*, the pushing force caused by this movement is transmitted to the bottom 78*a* through the first sliding member 75, and then the bottom 78*a* is pressed in the direction of the axis O. On the other hand, when moving the pushing/pulling member 31 toward a relative direction away from the bottom 78*a*, the first sliding member 75 abuts on the surfaces which face the bottom 78*a* of the overhangs 74*b* and 74*b* in the L-shaped guides 74 and 74 of the portal guide portion 73, and then the first sliding member 75 pushes such surfaces. Thus, the L-shaped guides 74 and 74 can be pulled in a direction wherein the L-shaped guides 74 and 74 go away from the bottom 78*a*. Therefore, the bottom 78*a* united with the L-shaped guides 74 and 74 can be pushed and/or pulled in the direction of the axis O.

Figure 8:
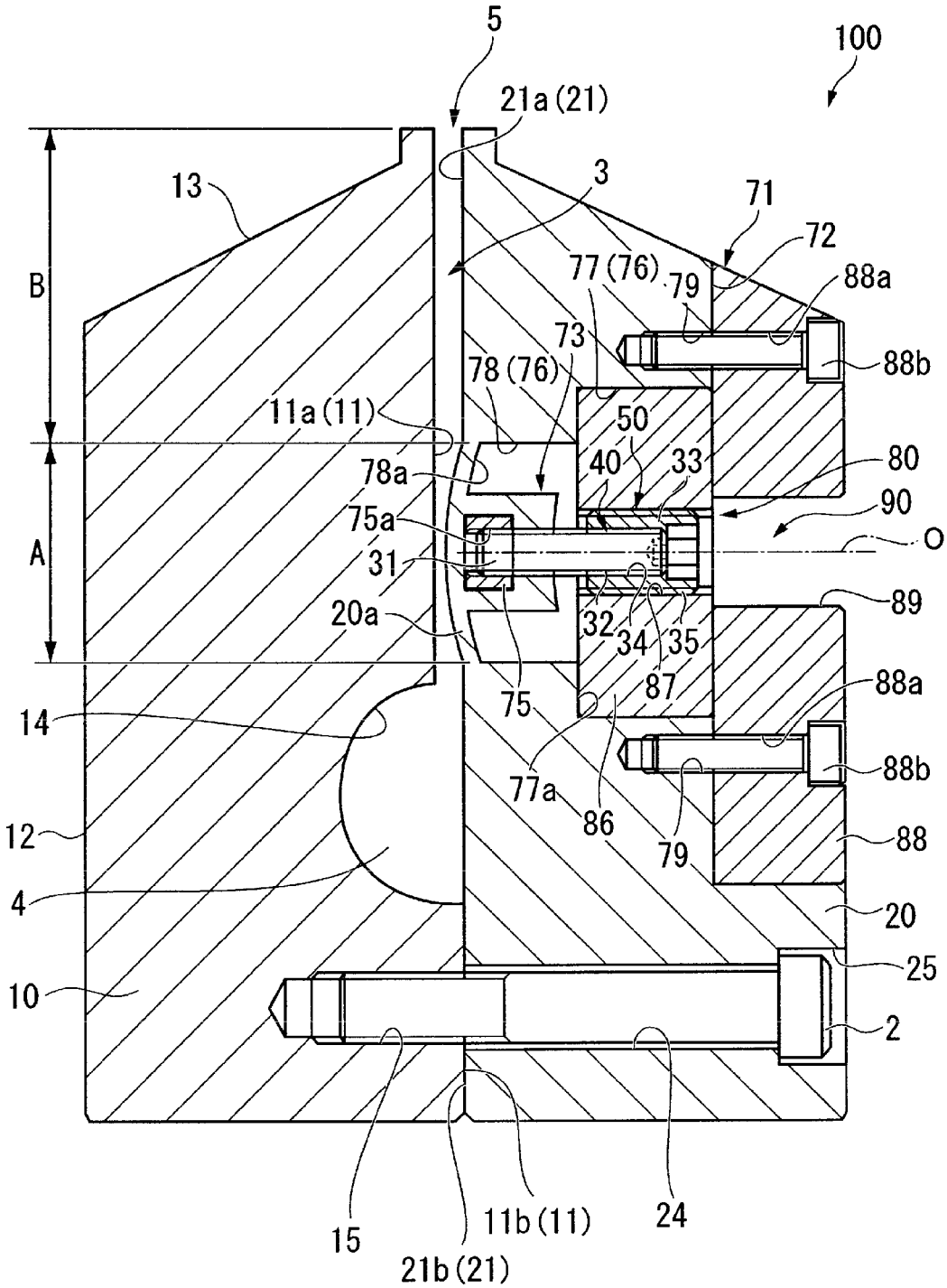
FIG. 8 is a sectional view perpendicular to the longitudinal direction when performing the flow-rate control of a coating liquid in the coating head shown in FIG. 5.

When pushing and/or pulling the bottom 78*a* in such manner, as shown in FIG. 8, the thin portion 20*a* is elastically deformed. Further, the portion back to the bottom 78*a* on the slot surface 21*a* of the other side head member 20, is elastically deformed, too. In the same way as the first embodiment, the slot surface 21*a* of the other side head member 20 rises convexly toward the slot surface 11*a* of the one side head member 10, and/or sinks concavely below the slot surface 21*a* away from the slot surface 11*a* of the one side head member 10. Thereby, the width of the slot 3 can be adjusted in the flow-rate control area A.

Here, in the coating head 100 of this embodiment, the pushing/pulling mechanism 80 is arbitrarily movable in the longitudinal direction. That is, by turning the rotational moving member 33 with the hexagonal wrench, the position thereof is adjusted in the direction of the axis O, and then releasing the bottom 78*a* from being pushed and/or pulled by the first sliding member 75 connected to the rotational moving member 33 through the pushing/pulling member 31, the first sliding member 75 becomes slidable in the longitudinal direction of the coating head 100. Thereby, when moving the second sliding member 86 in the longitudinal direction of the coating head 100, the first sliding member 75 also moves in the longitudinal direction. The first sliding member 75 is connected to the second sliding member 86 through the rotational moving member 33 and the pushing/pulling member 31.

Next, the first sliding member 75 and the second sliding member 86 are located at arbitrary positions in the longitudinal direction. In this situation, in the same way as mentioned above, by turning the rotational moving member 33 with the hexagonal wrench again, the pushing/pulling member 31 moves in the direction of the axis O, and can push and/or pull the bottom 78*a* through the first sliding member 75. Thereby, the fine adjustment in which the bottom 78*a* is slightly pushed and/or pulled at an arbitrary position in the longitudinal direction of the coating head 100, can be performed. In the coating head 100 of the second embodiment mentioned above, the pushing/pulling mechanism 80 can be arranged at a position in the longitudinal direction where the width of the slot 3, which is dependent on using conditions, changes easily over time. Thus, high precision flow-rate control can be performed.

Although the embodiments of the invention have been described hitherto, the invention is not limited thereto, and can be appropriately changed without departing from the technical idea thereof. For example, the pushing/pulling mechanism 30 or 80 in the embodiments has the structure in which the bottom 28*a* or 78*a* is pushed and/or pulled by turning the rotational moving member 33. However, the invention is not limited thereto; and other structures in which the bottom 28*a* or 78*a* can be pushed and/or pulled, are also usable.

For example, there may be a structure in which the bottom 28*a* or 78*a* is pushed only by oil pressure or the like. As this structure allows the interior surface 21 of the other side head member 20 to rise convexly toward the one side head member 10, the flow-rate of a coating liquid can be controlled easily.

Moreover, in the embodiments, the pitch of the first thread portion 40 is set to be smaller than that of the second thread portion 50. However, the converse of this, that is, the configuration in which the pitch of the second thread portion 50 is set to be smaller than the pitch of the first thread portion 40, is useable. In this case, the moving distance of the pushing/pulling member 31 can be larger than that caused by the rotation of the rotational moving member 33. Therefore, it becomes possible to effect great control over the flow-rate of a coating liquid with only a minor operation.

Additionally, in the second embodiment, the case of a structure in which only a single internal flow-rate control mechanism 90 is provided, has been described. A structure in which a plurality of internal flow-rate control mechanisms 90 is provided, is useable. In other words, the case in which a plurality of the pushing/pulling mechanisms 80 are arranged in the longitudinal direction of the coating head 100 is useable. Thereby, a high precision flow-rate control can be performed.

DESCRIPTION OF REFERENCE NUMERALS AND SIGNS

1: COATING HEAD
2: COUPLING BOLT
3: SLOT
4: POCKET
5: DISCHARGE PORT
10: HEAD MEMBER
11: INTERIOR SURFACE
11A: SLOT SURFACE
11B: ABUTTING SURFACE
12: EXTERIOR SURFACE
14: POCKET GROOVE
15: BOLTHOLE
20: HEAD MEMBER
20*a*: THIN PORTION
21: INTERIOR SURFACE
21*a*: SLOT SURFACE
21*b*: ABUTTING SURFACE
22: EXTERIOR SURFACE
24: BOLT INSERTION HOLE
25: COUNTERSUNK HOLE
26*a*: CONCAVITY
27: FIRST CONCAVITY
27*a*: BOTTOM
27*b*: BOLT-HOLE
28: SECOND CONCAVITY
28*a*: BOTTOM
29: BOLT FIXING PORTION
29*a*: BOLT FIXING HOLE
30: PUSHING/PULLING MECHANISM
31: PUSHING/PULLING MEMBER
32: FIRST EXTERNAL THREAD
33: ROTATIONAL MOVING MEMBER
33*a*: WRENCH FITTING HOLE
34: FIRST INTERNAL THREAD
35: SECOND EXTERNAL THREAD
36: LID MEMBER
36*a*: THROUGH HOLE
37: SECOND INTERNAL THREAD
38: BOLT INSERTION HOLE
39: COUPLING BOLT
40: FIRST THREAD PORTION
50: SECOND THREAD PORTION
60: INTERNAL FLOW-RATE CONTROL MECHANISM
72: EXTERIOR SURFACE
73: PORTAL GUIDE PORTION
74: L-SHAPED GUIDE
75: FIRST SLIDING MEMBER
75*a*: BOLT FIXING HOLE
76: CONCAVE GROOVE (CONCAVITY)
77: FIRST CONCAVE GROOVE
77*a*: BOTTOM
78: SECOND CONCAVE GROOVE
78*a*: BOTTOM
79: BOLTHOLE
80: PUSHING/PULLING MECHANISM
86: SECOND SLIDING MEMBER
86*a*: THROUGH HOLE
87: SECOND INTERNAL THREAD
88: LID PLATE
88*a*: BOLT INSERTION HOLE
88*b*: COUPLING BOLT
89: WRENCH INSERTION SLIT
90: INTERNAL FLOW-RATE CONTROL MECHANISM
100: COATING HEAD

The invention claimed is:

1. A coating tool comprising a coating head composed of a plurality of head members, wherein:

a grooved slot is formed between two interior surfaces which face each other in the plurality of head members, extends in the longitudinal direction of the coating head, and is open into the tip of the coating head, and the grooved slot has a flow-rate control area and a flow rate stabilizing area;

coating liquid flows through the slot, and is discharged from the tip of the coating head;

a convexity which rises toward one side surface of the two interior surfaces, can be formed convexly on the other side surface of the two interior surfaces by elastically deforming a portion on the other side surface;

a concavity which sinks away from the one side surface, can be formed concavely below the other side surface by elastically deforming a portion on the other side surface; and an internal flow-rate control mechanism is provided to control the flow-rate of the coating liquid in the slot by adjusting the above convexity and/or concavity, wherein the coating liquid flows from a pocket in which the coating liquid is filled and from which the slot extends to the tip side, the pocket being positioned close to the flow-rate control area, the flow-rate control area is positioned at a rear side of the convexity and/or concavity, and the flow-rate stabilizing area extends toward the tip side from the flow-rate control area.

2. The coating tool according to claim 1, wherein a plurality of the internal flow-rate control mechanisms are arranged in the longitudinal direction.

3. The coating tool according to claim 1, wherein the internal flow-rate control mechanism includes a concavity formed in the exterior surface of the other side head member at the rear of the other side interior surface; and a pushing/pulling mechanism which pushes and/or pulls the bottom of the concavity.

4. The coating tool according to claim 3, wherein the pushing/pulling mechanism includes a pushing/pulling member and a rotational moving member;

the pushing/pulling member extends along a direction to which the bottom is pushed and/or pulled;

one end of the pushing/pulling member is fixed to the bottom of the concavity;

the rotational moving member has a cylindrical shape;

an inner circumferential surface of the rotational moving member is rotatably attached to the pushing/pulling member by a first thread portion;

an outer circumferential surface of the rotational moving member is rotatably attached to the other side head member by a second thread portion; and a pitch of the first thread portion is set to be different from that of the second thread portion.

5. The coating tool according to claim 3, wherein the pushing/pulling mechanism is movable in the longitudinal direction.

6. The coating tool according to claim 5, wherein the pushing/pulling mechanism includes a first sliding member provided at the bottom to be slidable in the longitudinal direction, a second sliding member provided at the other side head member to be slidable in the longitudinal direction, a pushing/pulling member, and a rotational moving member;

the pushing/pulling member extends along a direction to which the bottom is pushed and/or pulled;

one end of the pushing/pulling member is fixed to the first sliding member;

the rotational moving member has a cylindrical shape;

an inner circumferential surface of the rotational moving member is rotatably attached to the pushing/pulling member by a first thread portion;

an outer circumferential surface of the rotational moving member is rotatably attached to the second sliding member by a second thread portion; and a pitch of the first thread portion is set to be different from that of the second thread portion.

7. The coating tool according to claim 2, wherein the internal flow-rate control mechanism includes a concavity formed in the exterior surface of the other side head member at the rear of the other side interior surface; and a pushing/pulling mechanism which pushes and/or pulls the bottom of the concavity.

* * * * *